US010512352B1

(12) United States Patent
Torres

(10) Patent No.: US 10,512,352 B1
(45) Date of Patent: Dec. 24, 2019

(54) SAFE DELIVERY BOX

(71) Applicant: Angelo Torres, North Miami Beach, FL (US)

(72) Inventor: Angelo Torres, North Miami Beach, FL (US)

( * ) Notice: Subject to any disclaimer, the term of this patent is extended or adjusted under 35 U.S.C. 154(b) by 0 days.

(21) Appl. No.: 16/388,662

(22) Filed: Apr. 18, 2019

(51) Int. Cl.
*A47G 29/22* (2006.01)

(52) U.S. Cl.
CPC ..... *A47G 29/22* (2013.01); *A47G 2400/126* (2013.01)

(58) Field of Classification Search
CPC ..... A47G 29/12; A47G 29/12095; A47G 29/1214; A47G 29/1216; A47G 29/124; A47G 29/1248; A47G 29/14; A47G 29/16; A47G 29/20; A47G 29/22; A47G 2029/144; A47G 2029/148; A47G 2029/149; A47G 2400/126
USPC ..... 232/17, 19, 45, 47, 48, 54, 1 E, 39, 232/34–36
See application file for complete search history.

(56) References Cited

U.S. PATENT DOCUMENTS 524,637 A * 8/1894 Johnson ..... A47G 29/1207 232/24
1,136,979 A * 4/1915 Slagow ..... A47G 29/1209 232/48
4,909,052 A * 3/1990 Hutwohl ..... A47G 29/20 109/50
5,027,948 A * 7/1991 Forbes ..... G11B 23/023 206/387.11
5,435,484 A * 7/1995 Carlson ..... A47G 29/1251 232/47
5,624,071 A * 4/1997 Sosan ..... A47G 29/20 232/1 B
6,155,715 A * 12/2000 Lake ..... A47G 29/20 150/102
7,036,719 B1 * 5/2006 Helphrey ..... A47G 29/1209 232/30
D574,124 S * 7/2008 Huber ..... D99/28
7,854,374 B2 * 12/2010 Dudley ..... A47G 29/12095 232/45
D644,814 S * 9/2011 Clarke ..... D99/33
8,336,760 B2 * 12/2012 Skouboe ..... A47G 29/22 232/45
10,143,320 B1 * 12/2018 Batts ..... A47G 29/20
10,143,321 B2 * 12/2018 Hippert ..... A47G 29/20
2016/0051073 A1 * 2/2016 Heinz ..... A47G 29/141 232/39
2016/0309939 A1 * 10/2016 Mencel ..... A47G 29/20
2017/0127868 A1 * 5/2017 Adewuyi ..... A47G 29/141

* cited by examiner

*Primary Examiner* — William L Miller
(74) *Attorney, Agent, or Firm* — Christopher J. VanDam, PA; Chris Vandam

(57) ABSTRACT

A safe delivery box that attaches to a walk in door with a hanger. A package is delivered by inserting it into the interior volume through a pair of tandem trap doors. The trap doors work together to prevent a package from being removed through the trap doors. While attached to the walk in door an access door is held against the walk in door so that the access door cannot be opened. When the walk in door is opened then the box may be removed from the walk in door and the access door may be opened to remove the delivered package.

4 Claims, 3 Drawing Sheets

SAFE DELIVERY BOX

BACKGROUND OF THE INVENTION

1. Field of the Invention

The present invention relates to home or office package delivery security, and more particularly, to an improved delivery box to safely and securely retain delivered packages.

2. Description of the Related Art

Several designs for delivery or mail boxes have been designed in the past. None of them, however, includes a box that hangs on an entry door and has the owner access door only accessible when the box is removed from the entry door and has two pairs of trap doors to prevent unauthorized removal of packages delivered into the box.

Other patents and known prior art devices disclose related or competing subject matter that provides for a number of more or less complicated features that fail to solve the problem in an efficient and economical way. None of these patents suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a safe delivery box that receives packages while the homeowner is away to prevent theft of those packages.

It is another object of this invention to provide a secure package delivery location that is easy to open by the owner of the box and it easy for a delivery person to deposit a package.

It is still another object of the present invention to provide a safe delivery box that is selectively deployable when a package delivery is expected.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
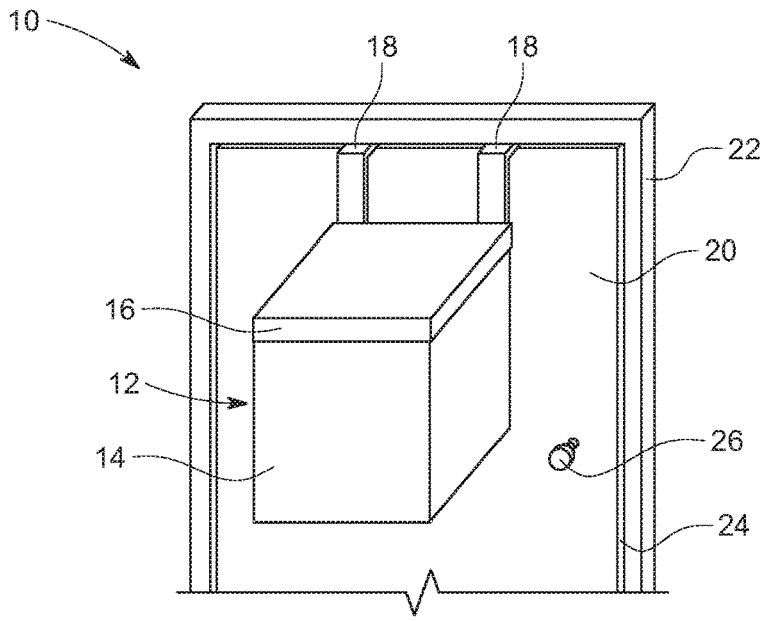
FIG. 1 shows a perspective view of a safe delivery box attached to a walk in door.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the box, the package delivery box, the safe delivery box, the security box, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation.

Referring now to the drawings, where the present invention is generally referred to with numeral 10, it can be observed that it basically includes a case assembly 12, a case 14, a cover 16, a hanger 18, a door 20, a frame 22, a gap 24, a handle 26, a hinge 28, a hinge 30, a hinge 32, a trap door 34, a trap door 36, a trap door 38, a hinge 40, an interior volume 42, a bottom 44, a side 46, a side 48, a trap door 50, a hinge 52, a back 54, a door 56, a lock 58, a sensor 60, a gap 62 and a panel 64.

FIG. 1 shows an example of a safe delivery box hung over the top of the door 20 by the hangers 18. The hangers 18 are shaped to hook over the top of the door 20 in the gap 24 between the door frame 22 and the door 20 itself. The entire weight of the device is supported by the hangers 18 on the door 20. The door 20 remains normally operable to open and close with the safe delivery box affixed to the door 20.

Because the hangers 18 are over the door the safe delivery box is only removable from the door 20 when the door 20 is open. This prevents theft of the entire device and also allows easy and quick installation and removal of the device. When the door 20 is open the user of the safe delivery box simply lifts the device off of the top edge of the door 20 and brings it inside to open the box to retrieve the contents and store it for another use at a later time.

Figure 2:
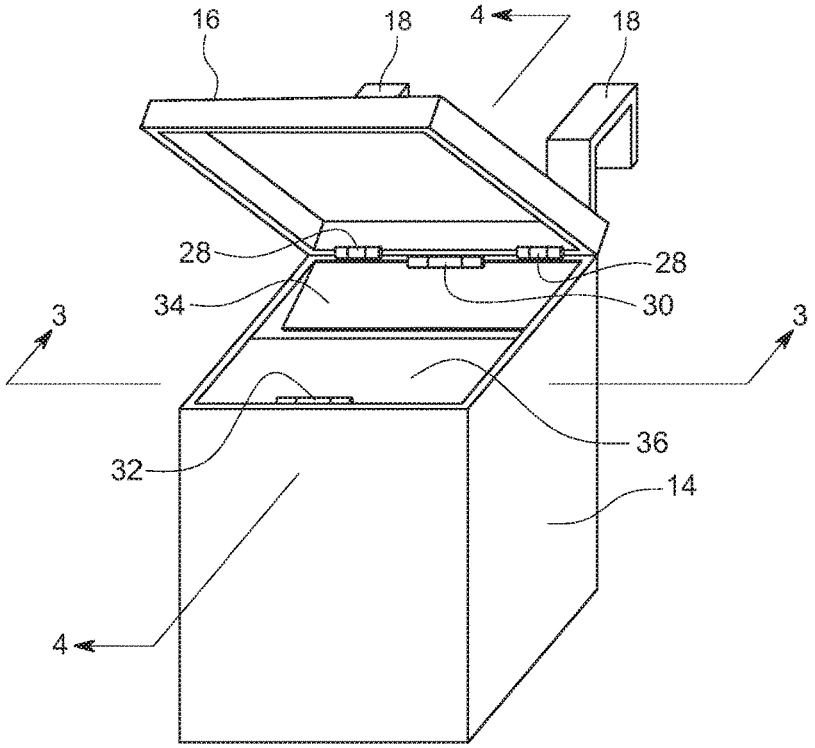
FIG. 2 shows a perspective view of the safe delivery box with the cover partially opened.
Figure 3:
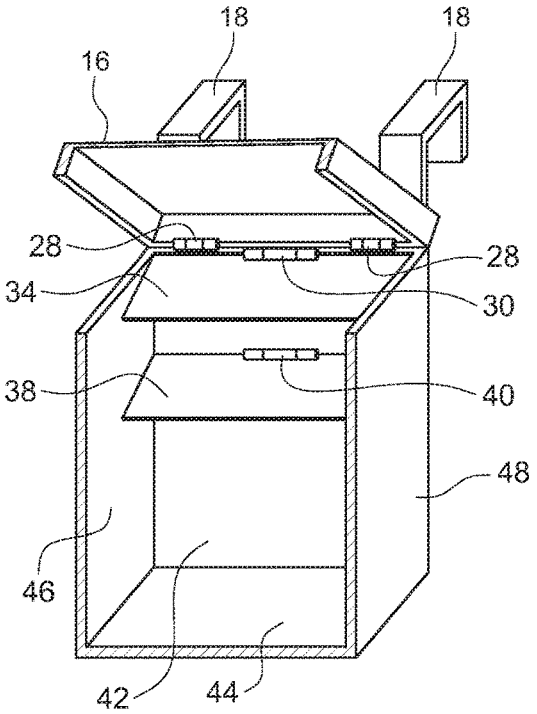
FIG. 3 shows a front perspective cross section view of the safe delivery box.
Figure 4:
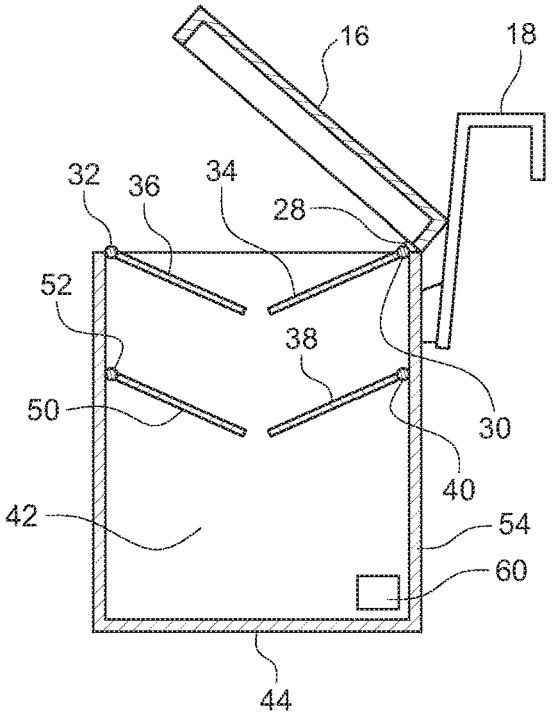
FIG. 4 shows a side elevation cross section view of the safe delivery box.

FIG. 2 shows the safe delivery box with the cover 16 partially opened about the hinge 28. The trap door 34 space is partially opened about the hinge 30. As a package is inserted into the interior volume 42, the trap door 34 and the trap door 36 are opened to access the interior volume 42. As shown in FIG. 4, the second set of trap doors 38 and 50 are also opened when a package is inserted into the interior volume 42 below the lower set of trap doors 38 and 50.

All of the trap doors 34, 36, 38 and 50 are spring biased in an upper position where each trap door 34, 36, 38 and 50 are horizontal. As a package is inserted into the device the trap doors 34, 36, 38 and 50 are opened downward to allow the package to be inserted into the safe delivery box. Once the package has been inserted then the trap doors 34, 38, 38 and 50 spring back up to the horizontal, closed position.

If someone would try to reach in through the trap doors 34, 36, 38 and 50 to remove a package inside the trap doors 34, 36, 38 and 50 tend to close at least partially thereby preventing the removal of the package. Essentially, the trap doors 34, 36, 38 and 50 act as a barb to allow the package to only be able to pass from the top into the interior volume 42 but will not allow a package to be pulled up past the trap doors 34, 36, 38 and 50.

The only way to be able to remove a package from the interior volume is to gain access to the door 56 on the back 54 of the safe delivery box. To access the door 56 the entire device must be removed from the entry door 20. To remove the device from the entry door 20 that door 20 must be opened so that the hangers 18 may be lifted off of the edge of the door 20.

Trap door 34 is provided with hinge 30. Trap door 36 is provided with hinge 32. Trap door 38 is provided with hinge 40. Trap door 50 is provided with hinge 52. Each of the hinges 30, 32, 40 and 52 allow movement of the respective trap doors 34, 36, 38 and 50 only in a downward direction when a package is inserted into the interior volume 42. The hinges 30, 32, 40 and 52 bias the respective trap doors 34, 36, 38 and 50 into a horizontal position and prevent the trap doors 34, 36, 38 and 50 from angling upwards.

A cover 16 is optionally provided to cover the top of the device. This can protect the delivered package from rain or other inclement weather. If the safe delivery box is used inside, for example in an apartment building the cover 16 may not be necessary. The cover 16 may also prevent a passerby from looking into the interior for a package and could reduce any temptation to remove the package without authorization from the owner of the package.

FIG. 4 shows an optional sensor 60. The sensor 60 may be placed in or on the case 14 or cover 16. The sensor 60 is electrically powered by a battery and wirelessly communicates with a network. The sensor 60 can be programmed to alert the owner of the safe delivery box that a package has been placed into the device.

Optionally, the sensor 60 may be characterized as a motion, proximity or image sensor. An image of the package may be delivered to the owner or just an alert. The sensor 60 may be configured to issue an alert or an alarm if the device is tampered with or is moved without the owner's authorization. In this sense the sensor 60 may also be a theft deterrent as well as providing notice that the system is operating normally and a package has been received.

The sensor 60 may include a rechargeable battery that periodically can be charges to provide sufficient power to operate the sensor 60. Other power sources may also effectively be employed, such as a solar cell or wall current. In either of these cases a battery may additionally be present to ensure constant power.

Figure 5:
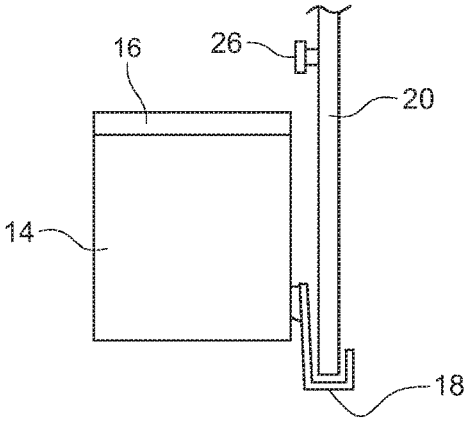
FIG. 5 shows a side elevation view of a safe delivery box attached to a bottom side of a door.

FIG. 5 shows the safe delivery box in an alternate configuration on the bottom edge of a door 20. The hangers 18 may be placed towards the bottom 44 of the device and then placed under the bottom edge of the door. This may be useful for doors 20 of certain configurations that are not amenable for hanger 18 placement over the top edge of the door 20. For example, some weather stripping may interfere with placement of the hangers 18 over the top of the door.

In another application the user of the device may find it easier to slide the hangers 18 under the bottom of the door 20 rather than have to lift the entire device, sometimes with a heavy package contained inside the interior volume 42, onto the top of the door 20. In this case the bottom 44 could be slid along the floor to engage the hangers 18 on or off the door 20 during normal operation.

In another version of the hanger 18 design the hangers 18 could be engaged into a side edge of the door 20. The hangers 18 would simply be repositioned to extend laterally from either side of the case 14. The hangers 18 in this sense are not used to hang the device on the door 20 but are used to prevent the entire safe delivery box from being removed without the owner of the device opening the door 20 to which it is attached and also to prevent an unauthorized user from gaining access to the package removal door 56 on the back 54.

Figure 6:
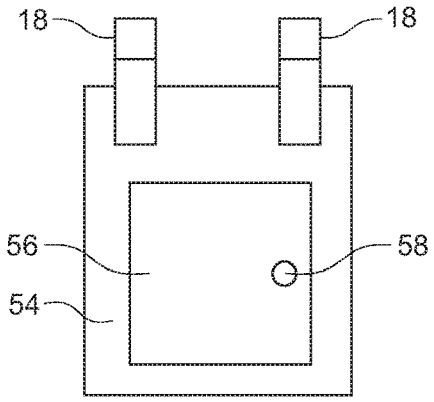
FIG. 6 shows a rear elevation view of a safe delivery box removed from the door.

FIG. 6 shows an optional lock 58 on the access door 56 on the back 54 of the safe delivery box. Having the hangers 18 on the door 20 with the back 54 of the device against the door 20 is the first line of defense in preventing unauthorized access to the interior volume 42 when the door 20 is closed. The addition of the lock 58 further improves security. The lock 58 could be keyed, operated with a combination, a biometric sensor or any other means or method to allow only the authorized user to be able to open the door 56 to access the package.

Figure 7:
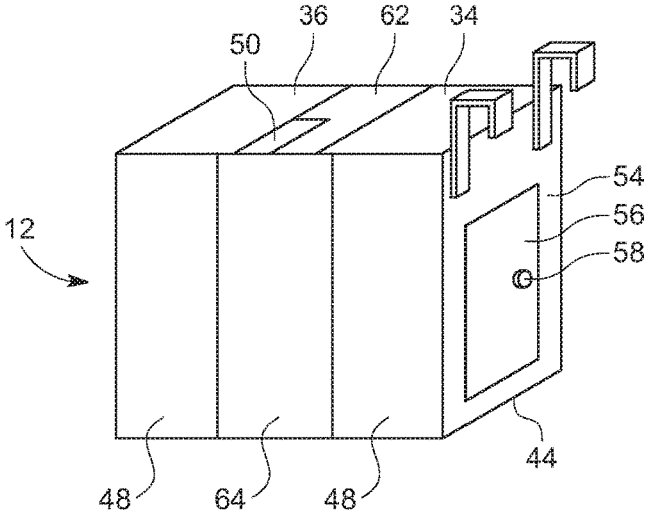
FIG. 7 shows a perspective view of a safe delivery box with optional expansion panels.

FIG. 7 shows an optional extension panel 64 inserted on the side 48 of the safe delivery box. A similar panel would also be placed on the opposite side and bottom 44 of the safe delivery box. This feature allows the owner of the safe delivery box to temporarily have a larger interior volume 42 when anticipating a larger package.

The side 48 (an equally opposing side 46 and bottom 44) may have a joint where a panel 64 could be inserted to expand that respective side. Similarly, instead of sliding in a panel 64 the panel 64 may have a hinge along the joint between the panel 64 and the sides 48 so that the panel 64 could simply be folded out to expand the dimensions of the safe delivery box.

When the user of the device wishes to return the box to the smaller size the panel 64 (and respective panels for the other sides) are simply folded in against the sides 48. The smaller mode may also be used for storage of the device when the safe delivery box is not in use on the door awaiting a delivery.

An important version of the invention can be fairly described as a safe delivery box for receiving package deliveries comprised of a case having an interior volume dimensioned to fit an anticipated package. A rear of the case has at least one hanger that hooks between a preselected walk-in door and door frame such that when the walk-in door is closed the hangers cannot be removed from the walk-in door and door frame. When the walk-in door is locked closed then the safe delivery box cannot be removed from the walk-in door. A first pair of opposed trap doors are biased (for example with a spring) in a horizontal position covering a top opening of the case. A second pair of opposed trap doors are biased (for example with a spring) in a horizontal position and are spaced below the first pair of opposed trap doors. The first and second pair of trap doors articulate down as a package is inserted into the case and then automatically return to the respective horizontal positions. The rear of the case has an access door through which packages are retrieved by the owner. The access door is openable only when the case is removed from against the walk-in door because while the case is against the walk-in door there is no room for the access door to open. This improves security of the device. Optionally, a sensor is affixed to the safe delivery box that can transmit a wireless notification that a package has been delivered into the case or other signal. Optionally, an expansion panel is inserted into a side panel to increase a size of the interior volume. Optionally, a cover is attached to the case that articulates into an open position to allow a package to be inserted into the interior volume.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A safe delivery box comprising a case having an interior volume;

a rear of the case has at least one hanger that hooks between a preselected walk-in door and door frame such that when the walk-in door is closed the at least one hanger cannot be removed from the walk-in door and door frame;

a first pair of opposed trap doors are each biased by a spring biased hinge in a horizontal position covering a top opening of the case;

a second pair of opposed trap doors are each biased by a spring biased hinge in a horizontal position and are spaced below the first pair of opposed trap doors;

the first and second pair of trap doors articulate down as a package is inserted into the case and then automatically return to the respective horizontal positions;

the rear of the case has an access door;

the access door is openable only when the case is removed from against the walk-in door.

2. The safe delivery box as in claim 1 further characterized in that a sensor is affixed to the safe delivery box that transmits a wireless notification that the package has been delivered into the case.

3. The safe delivery box as in claim 1 further characterized in that an expansion panel is inserted into a side panel of the case to increase a size of the interior volume.

4. The safe delivery box as in claim 1 further characterized in that a cover is attached to the case that articulates into an open position to allow the package to be inserted into the interior volume.

* * * * *